US007637253B2

(12) United States Patent
Remele et al.

(10) Patent No.: US 7,637,253 B2
(45) Date of Patent: Dec. 29, 2009

(54) METHOD AND APPARATUS FOR CONTROLLING AN INTERNAL COMBUSTION ENGINE

(75) Inventors: Jörg Remele, Hagnau (DE); Uwe Rödl, Friedrichshafen (DE); Andreas Schneider, Friedrichshafen (DE); Albrecht Debelak, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 237 days.

(21) Appl. No.: 11/821,548

(22) Filed: Jun. 22, 2007

(65) Prior Publication Data

US 2008/0000453 A1 Jan. 3, 2008

(30) Foreign Application Priority Data

Jun. 24, 2006 (DE) ..... 10 2006 029 082

(51) Int. Cl.
*F02M 51/00* (2006.01)

(52) U.S. Cl. ..... 123/480

(58) Field of Classification Search ..... 123/478, 123/480, 486, 488, 490, 494
See application file for complete search history.

(56) References Cited

U.S. PATENT DOCUMENTS

| | | | | |
|---|---|---|---|---|
| 5,575,264 | A * | 11/1996 | Barron | 123/486 |
| 5,839,420 | A * | 11/1998 | Thomas | 123/478 |
| 6,298,830 | B1 * | 10/2001 | Kono | 123/478 |
| 6,418,913 | B1 * | 7/2002 | Schmidt et al. | 123/480 |
| 6,561,164 | B1 * | 5/2003 | Mollin | 123/446 |
| 6,651,629 | B2 * | 11/2003 | McCoy et al. | 123/480 |
| 6,671,611 | B1 * | 12/2003 | Peltier | 701/104 |
| 6,775,607 | B2 * | 8/2004 | Koerner | 701/104 |
| 6,973,920 | B2 * | 12/2005 | Buck et al. | 123/480 |
| 7,475,676 | B2 * | 1/2009 | Remele et al. | 123/478 |
| 7,497,205 | B2 * | 3/2009 | Casarella et al. | 123/479 |
| 2002/0099492 | A1 * | 7/2002 | Okawa et al. | 701/104 |
| 2003/0079723 | A1 * | 5/2003 | Mollin | 123/446 |
| 2003/0200957 | A1 * | 10/2003 | Shinogle | 123/480 |
| 2007/0028899 | A1 * | 2/2007 | Allen | 123/494 |

FOREIGN PATENT DOCUMENTS

| | | |
|---|---|---|
| DE | 197 11 903 | 9/1998 |
| DE | 199 45 673 | 4/2001 |
| DE | 101 17 809 | 10/2002 |
| WO | WO 97/23717 | 7/1997 |

* cited by examiner

*Primary Examiner*—Thomas N Moulis
(74) *Attorney, Agent, or Firm*—Klaus J. Bach

(57) ABSTRACT

In an arrangement and a method for controlling an internal combustion engine including a control unit, an injector for injecting fuel into the combustion chambers of the engine, connecting lines interconnecting the engine control unit and the injector for transmitting signals therebetween and an intelligent electronic component provided with the injector for an integral structure, the electronic component comprises an electronic storage unit for storing data, a computing unit, a measuring unit for determining momentary actual injector values and an energy storage device for storing electric energy which is supplied to the electronic components and to the injector unit during engine operation via the connecting lines either constantly or only during the fuel injection procedure.

7 Claims, 1 Drawing Sheet

METHOD AND APPARATUS FOR CONTROLLING AN INTERNAL COMBUSTION ENGINE

BACKGROUND OF THE INVENTION

The invention resides in a method and an arrangement for controlling an internal combustion engine including an electronic engine control unit with a fuel injector for the injection of fuel into a combustion chamber of the engine and with connecting lines interconnecting the electronic engine control unit and the injector for the transmission of signals therebetween, the injector having a built-in intelligent electronic component.

For an accurate control of the fuel injection, individual parameters of an injector are deposited in a storage device, for example, a EEPROM. This device is arranged in the injector. During engine operation, the parameters are readout by the electronic engine control unit and the calculated control values for that injector are accordingly adapted to using the parameters. WO 97/23717A discloses such a system.

DE 197 11 903 A1 discloses a piezo-injector with an Application Specific Integrated Circuit (ASIC) forming an integral construction unit. The integrated circuit includes a monitoring arrangement, an electronic switch and a zener diode. By means of the integrated circuit, the charging duration of the piezo operating member is monitored. Energy is supplied to the integrated circuit via the connecting line at the same time as the piezo operating member is charged. Outside the charging period, the integrated circuit is deactivated. No information exchange with the electronic engine control unit is possible with this system.

It is the object of the present invention to provide an intelligent fuel injector capable of communicating with the electronic control unit of the engine in which it is installed.

SUMMARY OF THE INVENTION

In an arrangement and a method for controlling an internal combustion engine including a control unit, an injector for injecting fuel into the combustion chambers of the engine, connecting lines interconnecting the engine control unit and the injector for transmitting signals therebetween and an intelligent electronic component provided with the injector for an integral structure, the electronic component comprises an electronic storage unit for storing data, a computing unit, a measuring unit for determining momentary actual injector values, and an energy storage device for storing electric energy which is supplied to the electronic components and to the injector unit during engine operation via the connecting lines either constantly or only during the fuel injection procedure.

The energy is transmitted from the electronic engine control unit to the energy storage device by way of the connecting lines discontinuously, particularly during the injection procedure. Alternatively, the energy is transmitted from the electronic engine control unit to the energy storage device in a continuous manner. As energy storage device for example, a condenser may be used.

Advantageously, the existing connecting lines can be used for bi-directional communication from the electronic engine control unit to the injector and vice versa. At the same time, energy can be transmitted to the energy storage device. If a connecting line comprises a two-wire line, no additional wiring is necessary so that also the reliability is increased.

Preferred embodiments of the invention will be described below on the basis of the accompanying drawings.

DESCRIPTION OF PARTICULAR EMBODIMENTS

Figure 1:
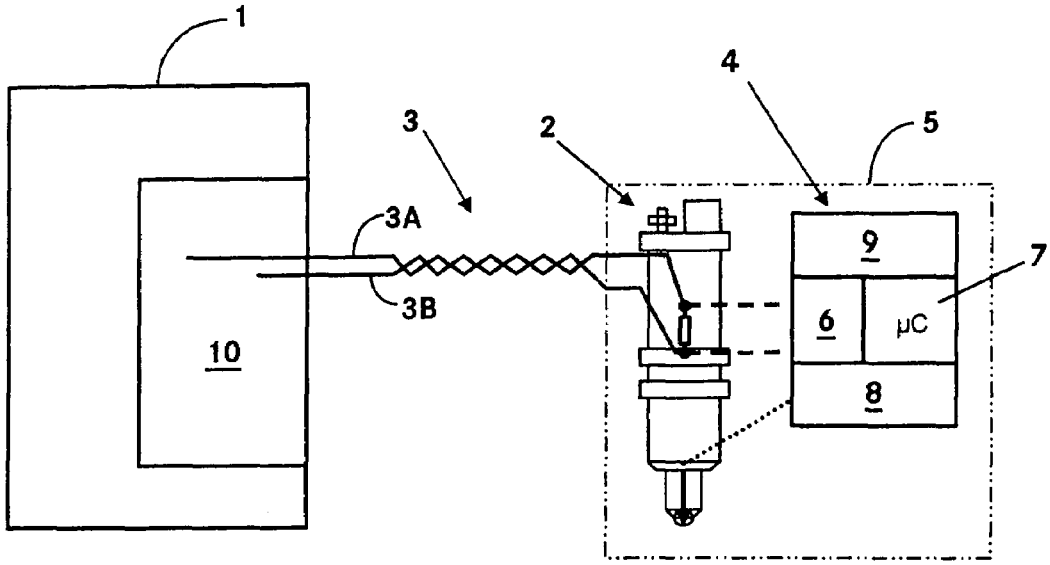
FIG. 1 shows an embodiment of the invention including a two-wire connecting line between the engine control unit and a fuel injector.

As shown in FIG. 1, the arrangement according to the invention comprises the following subassemblies: an electronic engine control unit 1, connecting lines 3, an injector 2 and an intelligent electronic component 4 which forms with the injector 2 a common unit 5. The connecting lines 3 are present in the form a two-wire twisted pair cable including two wires 3A and 3B. The injector 2 may be an inductive injector or a piezo injector. The electronic component 4 comprises an electronic storage unit 6 for storing data, a computation unit 7, a measuring technique unit 8 for determining actual injector values and an energy storage device 9. The measuring unit 8 determines for example the opening and closing of the injectors from the armature impact upon closing. Actual injector values are the design parameters as well as momentary measurement values, in particular for a detection of an injector drift.

The arrangement according to the invention operates as follows:

Via the connecting lines 3, the injector 2 is activated (injection begin) or deactivated (end of injection). Upon activation of the injector 2, concurrently energy is transmitted from the power stage 10 of the electronic engine control unit 1 via the connecting line 3 to the energy storage unit 9. The energy storage unit is charged during the fuel injection. Upon deactivation of the injector 2 also the transmission of energy to the energy storage unit is terminated. During the following injection pause, the electronic component 4 is supplied with energy from the energy storage device 9. In this way, a bi-directional communication can be established in the injection pause. For example, the electronic engine control unit 1 can read out data from the storage unit 6, if required it can supplement the data in the storage unit 6 with new parameters and it can cause the measuring unit 8 to perform additional measurements.

Figure 2:
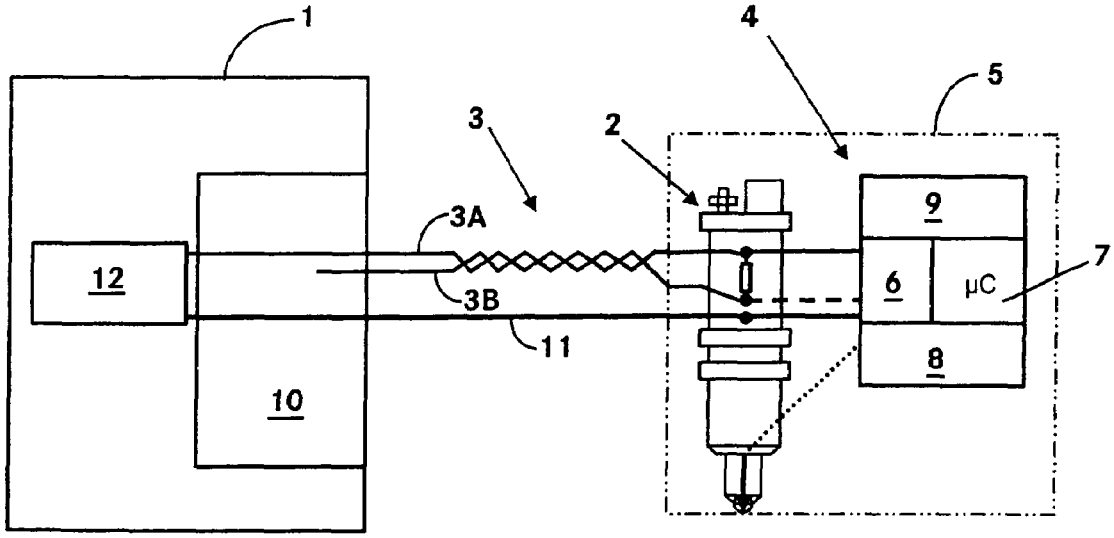
FIG. 2 shows another embodiment with a three-wire connecting line between the engine control unit and a fuel injector.

The second embodiment shown in FIG. 2 differs from the first embodiment in that a third connecting line 11, for example a ground line, is provided. Within the electronic engine control unit 1, this line is connected to an auxiliary energy supply 12. In this embodiment, energy is always supplied to the energy storage device 9. The injector control and the energy transmission to the energy storage unit are electrically uncoupled. There is no need then for a strict limitation of the energy use of the electronic component 4. The energy storage device 9 operates as explained above.

What is claimed is:

1. An arrangement for controlling an internal combustion engine including an electronic engine control unit (1), an injector (2) for injecting fuel into a combustion chamber of the internal combustion engine, connecting lines (3) extending between the engine control unit (1) and the injector (2) for the transmission of signals therebetween, an intelligent electronic component (4), forming, together with the injector (2) an integral unit (5), said intelligent electronic component (4) comprising an electronic storage unit (6) for storing data, a computing unit (7), a measuring unit (8) for determining momentary actual injector values and an energy storage device (9) for storing electric energy and for supplying energy to the electronic component (4) during operation of the internal combustion engine.

2. An arrangement according to claim 1, wherein the connecting line (3) is a two-wire conductor (3A, 3B).

3. An arrangement according to claim 1, wherein the connecting line (3) is a three-wire conductor (3A, 3B, 11) and the electronic engine control unit (1) includes an auxiliary energy supply (12) for the intelligent component (4).

4. A method of controlling an internal combustion engine including an electronic engine control unit (1), an injector (2) for injecting fuel into a combustion chamber of the internal combustion engine, connecting lines (3) extending between the engine control unit (1) and the injector (2) for the transmission of signals therebetween, an intelligent electronic component (4), forming, together with the injector (2), an integral unit (5), said intelligent electronic component (4) comprising an electronic storage unit (6) for storing data, a computing unit (7), a measuring unit (8) for determining momentary actual injector values and an energy storage device (9) for storing electric energy and for supplying energy to the electronic component (4) during operation of the internal combustion engine, said method comprising the step of transmitting energy from the electronic engine control unit (1) to the energy storage device (9) via the connecting line (3) during operation of the internal combustion engine.

5. The method according to claim 4, wherein energy is transmitted from the electronic engine control unit (1) to the energy storage device (9) in a discontinuous manner.

6. The method according to claim 5, wherein the transmission energy begins with the activation of the injector (1) and is performed during fuel injection of the injector (1).

7. The method according to claim 4, wherein the connecting line (3) is a three-wire line the energy transmission from the electronic motor control unit (1) to the energy storage device (9) via the connecting lines is continuous as long as the engine is in operation.

* * * * *